US010248051B2

(12) United States Patent
Takahashi

(10) Patent No.: US 10,248,051 B2
(45) **Date of Patent: *Apr. 2, 2019**

(54) DEVELOPING METHOD IN A DEVELOPER DEVICE HAVING A MECHANISM TO REDUCE SCATTERING OF TONER

(71) Applicants: KABUSHIKI KAISHA TOSHIBA, Tokyo (JP); TOSHIBA TEC KABUSHIKI KAISHA, Tokyo (JP)

(72) Inventor: Nobuaki Takahashi, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/901,980

(22) Filed: Feb. 22, 2018

(65) Prior Publication Data

US 2018/0181029 A1 Jun. 28, 2018

Related U.S. Application Data

(63) Continuation of application No. 15/253,875, filed on Sep. 1, 2016, now Pat. No. 9,910,388.

(30) Foreign Application Priority Data

Jan. 15, 2016 (JP) ..... 2016-006666

(51) Int. Cl.
*G03G 15/09* (2006.01)
*G03G 21/20* (2006.01)

(52) U.S. Cl.
CPC ..... *G03G 15/0928* (2013.01); *G03G 15/0921* (2013.01); *G03G 21/206* (2013.01)

(58) Field of Classification Search
CPC ..... G03G 15/09; G03G 15/0921; G03G 15/0928; G03G 21/206
See application file for complete search history.

(56) References Cited

U.S. PATENT DOCUMENTS

2015/0093139 A1 4/2015 Kuramoto et al.

FOREIGN PATENT DOCUMENTS

JP H08-185046 A 7/1996

*Primary Examiner* — Hoang Ngo
(74) *Attorney, Agent, or Firm* — Kim & Stewart LLP

(57) ABSTRACT

A developing method in a developer device having a developing roller configured to rotate within a housing, the developing roller having a first portion that is exposed through an opening of the housing, a second portion at which developer attached to the developing roller separates from the developing roller and a third portion between the first and second portions, and an elastic sheet in contact with the developing roller between the second and third portions of the developing roller, the method includes guiding airflow along a first airflow passage, which is formed in the housing and partially facing the second portion of the developing roller, and guiding airflow along a second airflow passage facing the third portion of the developing roller and adjacent to the first airflow passage.

9 Claims, 10 Drawing Sheets

DEVELOPING METHOD IN A DEVELOPER DEVICE HAVING A MECHANISM TO REDUCE SCATTERING OF TONER

CROSS-REFERENCE TO RELATED APPLICATIONS

This application is a continuation of U.S. patent application Ser. No. 15/253,875, filed on Sep. 1, 2016, which is based upon and claims the benefit of priority from Japanese Patent Application No. 2016-006666, filed Jan. 15, 2016, the entire contents of each of which are incorporated herein by reference.

FIELD

Embodiments described herein relate generally to a developer device and an image forming apparatus using the developer device.

BACKGROUND

Generally, in an image forming apparatus such as a copier and a printer, toner from a developer device of an image forming unit of the image forming apparatus is scattered inside the image forming apparatus. The scattered toner is adhered onto an electrostatic charger or the like, and causes the apparatus to malfunction. To reduce the scattering of the toner, measures such as providing a filter, a fan, or the like for collecting the scattered toner may be required.

DETAILED DESCRIPTION

According to an embodiment, there is provided a developer device reducing a scatter of a toner included in a developer and an image forming apparatus using the developer device.

In general, according to one embodiment, there is provided a developing method in a developer device having a developing roller configured to rotate within a housing, the developing roller having a first portion that is exposed through an opening of the housing, a second portion at which developer attached to the developing roller separates from the developing roller and a third portion between the first and second portions, and an elastic sheet in contact with the developing roller between the second and third portions of the developing roller, the method including: guiding airflow along a first airflow passage, which is formed in the housing and partially facing the second portion of the developing roller, and guiding airflow along a second airflow passage facing the third portion of the developing roller and adjacent to the first airflow passage.

Hereinafter, the embodiment of the disclosure will be described with reference to the accompanying drawings. In the present embodiment, as an image forming apparatus, a multi-function peripheral (MFP) will be described as an example.

Figure 1:
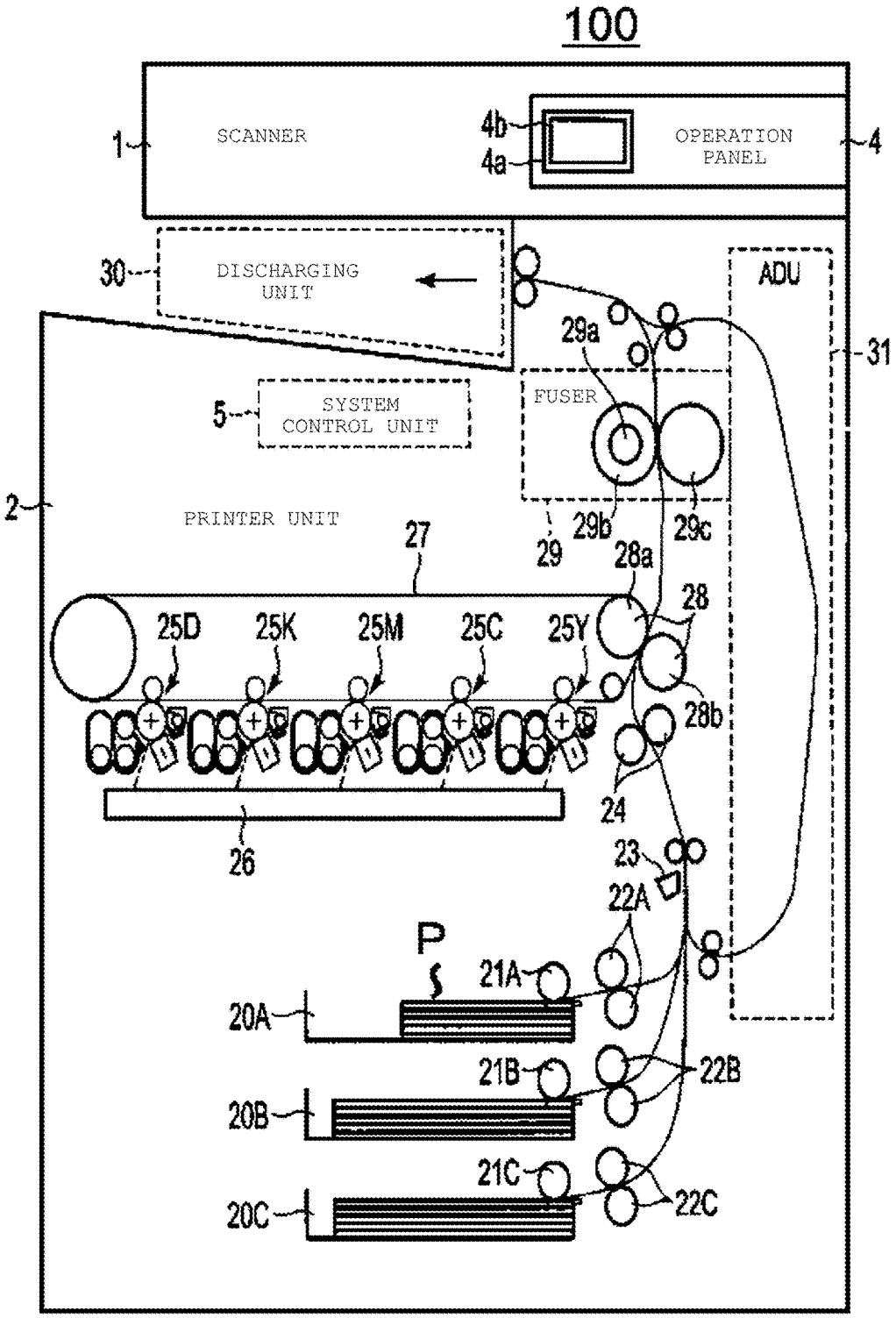
FIG. 1 is a cross-sectional view schematically illustrating an image forming apparatus according to the present embodiment.

The present embodiment will be described with reference FIGS. 1 to 8. FIG. 1 is a cross-sectional view schematically illustrating a configuration example of an MFP 100 according to the present embodiment. The MFP 100 as shown in FIG. 1 includes a scanner 1, a printer unit 2, an operation panel 4, and a system control unit 5.

The system control unit 5 controls the scanner 1, the printer unit 2, the operation panel 4, or the like. The system control unit 5 includes a CPU, a ROM, and a RAM.

The scanner 1 is arranged on the upper side of the MFP 100 main body and is a device which reads an image of an original document and converts the image to image data. The scanner 1 has a well-known configuration and includes, for example, a CCD line sensor which converts an image of an original document on a read surface to image data, or the like. The scanner 1 may scan an original document placed on a platen glass (not shown) while moving or read an image of an original document transported by an auto document feeder (ADF) without moving. The scanner 1 is controlled by the system control unit 5.

The printer unit 2 forms an image on a recording medium, such as paper P. In the present embodiment, the printer unit 2 includes an electrophotographic image forming unit. For color images, the printer unit 2 forms an image using a plurality of colors (for example, yellow (Y), cyan (C), magenta (M), black (K), and decolorable color (D)) of toners. The decolorable toner is decolored when heat is applied at a predetermined decoloring temperature that is higher than the fusing temperature. The toners of yellow (Y), cyan (C), magenta (M), and black (K) are non-decolorable toners which cannot be decolored even when heat is applied at temperatures higher than the fusing temperature. The color of the decolorable toner (D) is, for example, dark blue or black.

The decolorable toner to be used in the present embodiment is obtained by adding of a color material to a binder resin for example. A decolorable material contains a coloring compound, a developer, and a color developer. An example of the coloring compound contains a leuco dye or the like. One example of the developer contains phenols or the like. When applying heat to the color developer, the color developer is solubilized with the coloring compound. One example of the color developer contains a material without an affinity for the developer. The decolorable material is developed through an interaction of the coloring compound and the developer. The interaction of the coloring compound and the developer is interrupted by applying heat at a predetermined temperature, known as the decoloring temperature, or higher. When such heat is applied, the decolorable material is decolored.

In the configuration example shown in FIG. 1, the printer unit 2 includes a sheet feed cassettes (20A, 20B, and 20C) as a sheet feeder. For example, each of the sheet feed cassettes 20A, 20B, and 20C is inserted at a location under the MFP 100 main body in a removable manner. These sheet feed cassettes 20A, 20B, and 20C store different types and sizes of papers P. In addition, after the papers P having a different size are stored in these sheet feed cassettes 20A, 20B, and 20C, for example, the type can be set in each sheet feed cassette corresponding to each size. A sheet feeder sensor is provided in each of the sheet feed cassettes 20A, 20B, and 20C. The sheet feeder sensor detects a storage capacity of the corresponding sheet feed cassette. An example of the sheet feeder sensor includes an infrared sensor. A mechanical sensor, such as the well-known micro switch, also can be used. The sheet feeder sensor transmits the detection result to the system control unit 5. In addition, the printer unit 2 may include a well-known manual feed tray (not shown) as another sheet feeder. For example, in the present embodiment, in order to form an image, white paper P is placed in the sheet feed cassette 20A. The paper P which has an image to be removed maybe placed in the sheet feed cassette 20B. In other words, the paper P having an image formed with a decolorable toner is placed in the sheet feed cassette 20B. In such a case, a decoloring unit that removes the image formed on the paper is provided in MFP 100.

Setting information indicating a size and/or type of paper P is stored in a nonvolatile memory. The printer unit 2 selects one of the sheet feed cassettes 20A, 20B, and 20C, in which the paper P having the size and/or type indicated by the setting information, is stored. The printer unit 2 prints an image on the paper P fed from the selected sheet feed cassette. In a case where printer unit 2 includes the manual feed tray, a size of the paper P set in the manual bypass tray input from the operation panel 4 may be stored in the above-described nonvolatile memory.

In the following description of the image forming, since the paper is transported from a sheet feeder 20 (representing sheet feed cassettes 20A, 20B, and 20C, collectively) to a discharging unit 30 (described below), the sheet feeder 20 side is defined as an upstream side and the discharging unit 30 side is defined as a downstream side.

A transporting roller 22 (representing one of transporting rollers 22A, 22B, and 22C shown in FIG. 1) transports the paper P arranged along a transporting passage of the paper in the printer unit 2 from sheet feeder 20 to the discharging unit 30. The transporting roller 22 is driven by a motor (not shown). The transporting roller 22 transports the paper P fed from the corresponding sheet feed cassette 20A, 20B, or 20C by a pickup roller 21A, 21B, or 21C to a resist roller 24 which is arranged at the upstream side of a transfer unit 28. The resist roller 24 transports the paper P to a transfer position at a timing when an image is transferred from an intermediate transfer belt 27 onto the paper P.

Figure 2:
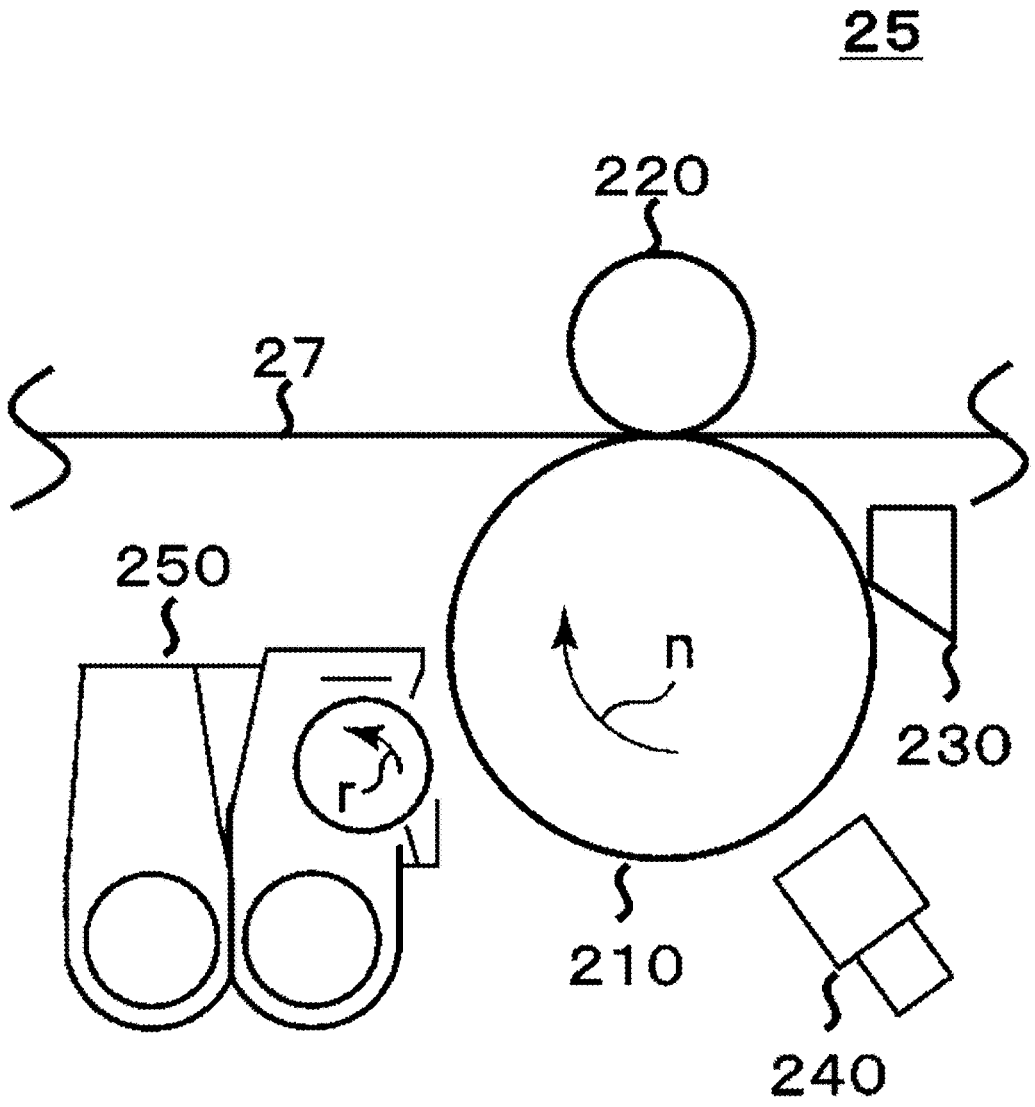
FIG. 2 is a cross-sectional view schematically illustrating an image forming unit according to the present embodiment.

Details of the image forming will be described with reference to FIGS. 1 and 2. An image forming unit 25 includes a developer device 250, an exposure unit 26, the intermediate transfer belt 27, and the transfer unit 28. The image forming unit 25 forms an image to be transferred on the paper. In the configuration example for generating a color image shown in FIG. 1, a color of an original document is separated and the image corresponding to yellow is formed with yellow toner in an image forming unit 25Y, as described later. Similarly, an image forming unit 25M forms a corresponding image with magenta toner. An image forming unit 25C forms a corresponding image with cyan toner. An image forming unit 25K forms a corresponding image with black toner. Each of the image forming units 25Y, 25M, 25C, and 25K combines and transfers each color toner image on the intermediate transfer belt 27. On the other hand, the image forming unit 25D is used in a case where the paper has an image formed with the decolorable toner. As described above, the color of the decolorable toner is dark blue and black. Accordingly, the image formed by the image forming unit 25D is a monochrome (monochrome color) image. In addition, each image forming unit 25Y, 25M, 25C, 25K, and 25D includes a photoreceptor drum 210, a primary transfer roller 220, a photoreceptor charger 240, a cleaner unit 230, and the developer device 250. As shown in FIG. 2, the primary transfer roller 220 which is arranged to press the photoreceptor drum 210 against the intermediate transfer belt 27, the cleaner unit 230 which removes remaining toner from the photoreceptor drum 210, the photoreceptor charger 240 which charges the photoreceptor drum 210, and the developer device 250 which feeds developed toner to the photoreceptor drum 210 so that an electrostatic latent image formed on the photoreceptor drum may be developed are arranged around a photoreceptor drum 210 in sequence from the upstream side of the rotation direction n of the photoreceptor drum 210. The image forming unit 25D is used only in cases where the paper is to be reused. The toner used is different among the image forming units while the configuration and the operation of the image forming units are identical. Therefore, the configuration and the operation of the image forming units will be described at the same time.

Hereinafter, an image forming process in an electrophotographic system will be described in detail. Each of the image forming units 25Y, 25M, 25C, 25K, and 25D includes a sensor such as a potential sensor and a density sensor (not shown). The potential sensor is a sensor that detects a surface potential of the photoreceptor drum 210 included in each image forming unit. In each of the image forming units 25Y, 25M, 25C, 25K, and 25D, the photoreceptor charger 240 charges the surface of the photoreceptor drum 210 before being exposed by the exposure unit 26. The system control unit 5 can change a charging condition of the photoreceptor charger 240. The potential sensor detects a surface potential in the photoreceptor drum 210 in which the surface is charged by the photoreceptor charger 240. The density sensor detects a density of a toner image transferred onto the intermediate transfer belt 27. In addition, the density sensor may be a sensor for detecting the density of the toner image formed on the photoreceptor drum 210.

The exposure unit 26 forms the electrostatic latent image of the original document image, that is obtained by the scanner 1, by irradiating laser light on the charged photoreceptor drum 210 of each image forming units 25Y, 25M, 25C, 25K, and 25D, as described below. The electrostatic latent image formed on each photoreceptor drum 210 is an image to be developed with each color toner. That is, the exposure unit 26 irradiates each photoreceptor drum 210 with the laser light corresponding to each image forming unit controlling according to image data through an optical system such as a polygon mirror. The exposure unit 26 controls power of the laser light according to a control signal from the system control unit 5. The exposure unit 26 controls also a modulation amount of a pulse width to control light emitting of the laser light or the like according to the control signal from the system control unit 5.

As described above, each of the image forming units 25Y, 25M, 25C, 25K, and 25D develops the electrostatic latent image formed on each of the photoreceptor drum 210 with the corresponding color toner using the developer device 250. Each of the image forming units 25Y, 25M, 25C, 25K, and 25D forms the toner image as a visible image on the photoreceptor drum 210. In a case where a color image is formed, each of the image forming units 25Y, 25M, 25C, and 25K transfers the toner image formed on the photoreceptor drum 210 on the intermediate transfer belt 27. Specifically, each of the image forming units 25Y, 25M, 25C, and 25K applies a transfer bias to the toner image at a primary transfer position (for example, a side where the photoreceptor drum 210 is in contact with the intermediate transfer belt 27). Each of the image forming units 25Y, 25M, 25C, and 25K controls the transfer bias by a transfer current. The toner image of each photoreceptor drum 210 is transferred to the intermediate transfer belt 27 by the transfer bias at each primary transfer position. The system control unit 5 controls the transfer current to be used in a primary transfer process by each image forming unit. On the other hand, in a case where the paper is reused, that is, a case where the monochrome image is formed with the decolorable toner, the toner image is formed as a visible image on the photoreceptor drum 210 by the image forming unit 25D. As described above, the toner image is transferred to the intermediate transfer belt 27.

The transfer unit 28 includes a supporting roller 28*a* and a secondary transfer roller 28*b* which are provided along a transport passage of the paper P. The transfer unit 28 measures a transfer timing by the resist roller 24 in the secondary transfer position and transfers the toner image on the intermediate transfer belt 27 onto the paper P to be transported. The secondary transfer position is a position where the supporting roller 28*a* faces the secondary transfer roller 28*b* with the intermediate transfer belt 27 interposed in between. The transfer unit 28 applies the transfer bias that is controlled according to the transfer current, to the intermediate transfer belt 27 of the secondary transfer position. The transfer unit 28 transfers the toner image on the intermediate transfer belt 27 by the transfer bias onto the paper P. The system control unit 5 controls the transfer current to be used in the secondary transfer process.

The fuser 29 arranged on the downstream side of the above-described transfer unit 28 performs the function of fusing the transferred toner onto the paper P. For example, in the present embodiment, the fuser 29 fuses the toner image on the paper P by heat and pressure applied to the paper P.

Figure 3:
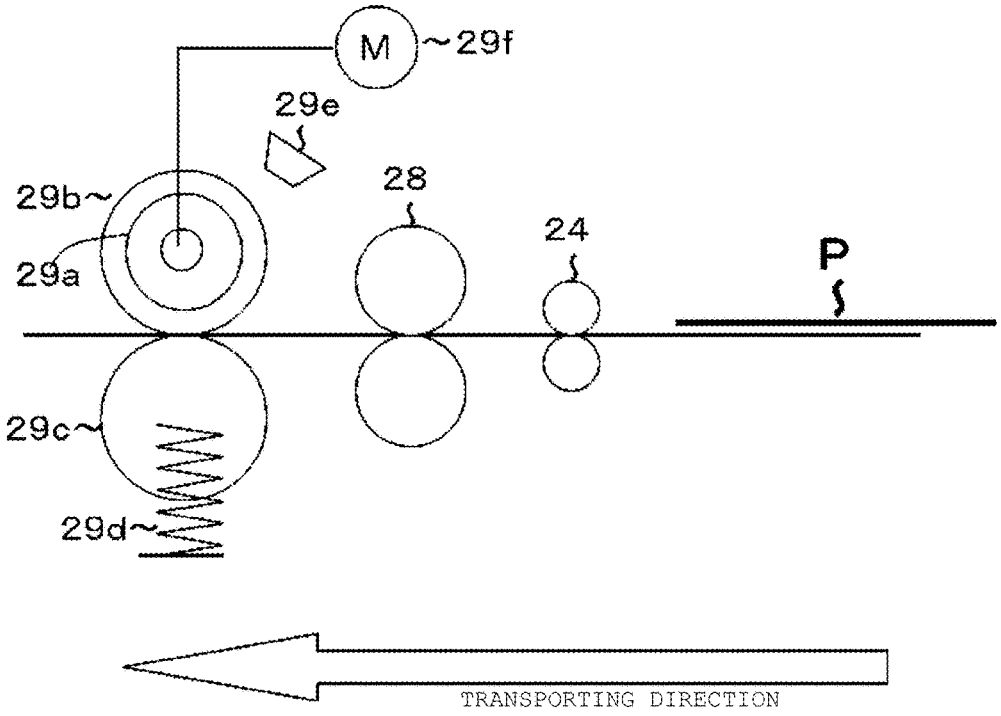
FIG. 3 is an explanatory diagram schematically illustrating a relationship between a resist roller, a fuser, and a transfer unit according to the present embodiment.

In the configuration examples shown in FIGS. 1 and 3, the fuser 29 includes a heat roller (heating unit) 29*b* including a heating source 29*a* therein and a pressure roller (pressing unit) 29*c* which is in contact with the heat roller 29*b* by being pressed against the heat roller 29*b* by a pressure mechanism 29*d*. The heating source 29*a* maybe a well-known heater of which a temperature is controlled. For example, the heating source 29*a* may be a lamp heater such as a halogen lamp or may be an induction heating (IH) type heater. In addition, the heating source 29*a* may include a plurality of heaters. Furthermore, the fuser 29 includes a temperature sensor 29*e* that measures a temperature of a heat roller 29*b*, additionally. The temperature sensor 29*e* transmits the temperature of the heat roller 29*b* to the system control unit 5. The system control unit 5 controls the temperature transmitted from the temperature sensor 29*e* and controls the heating source 29*a*, and controls the temperature of the heat roller 29*b*. The pressure mechanism 29*d* presses the pressure roller 29*c* against the heat roller 29*b*. The pressure mechanism 29*d* includes an elastic member. In a case where the pressure roller 29*c* is not pressed against the heat roller 29*b* by the pressure mechanism 29*d*, the pressure roller 29*c* is separated from the heat roller 29*b* and a gap is formed between the pressure roller 29*c* and the heat roller 29*b*. In addition, the heat roller 29*b* is rotated and driven by a driving unit 29f. The pressure roller 29*c* is rotated and driven by the heat roller 29*b* when the pressure roller 29*c* is pressed against the heat roller 29*b*. As shown in FIG. 3, the resist roller 24, the transfer unit 28, and the fuser 29 are provided in that order in a transporting direction of the paper P.

In a case where a fusing process for fusing the toner image on the paper P or a removing process for removing the image formed on the paper P are performed, the system control unit 5 controls the temperature of the fuser 29 to be a predetermined fusing temperature or a predetermined image removing temperature.

In the fusing process, the paper P stored in the sheet feed cassette 20A is picked up by the pickup roller 21A and the paper P is transported to the transfer unit 28. As described above, the image is transferred onto the paper P by the transfer unit 28. The fuser 29 presses the paper P in which the toner image is transferred, by the heat roller 29*b* and the pressure roller 29*c* which are heated to be at the predetermined temperature and is heated to be at the fusing temperature. Therefore, the fuser 29 fuses the toner image onto the paper P. In addition, in the image removing process, the paper P stored in the sheet feed cassette 20B is picked up by the pickup roller 21B and is transported along the transporting passage to the fuser 29. During this process, the transfer by the transfer unit 28 is not performed. The fuser 29 presses the paper P in which the image is formed with the decolorable toner, by the heat roller 29*b* and the pressure roller 29*c* which are heated at the predetermined image removing (decoloring) temperature and heats the paper P at the image removing temperature. Therefore, the fuser 29 decolors the toner and removes the image formed on the paper P.

When the fusing process or the image removing process is terminated, the paper P which is subjected to the fusing process is transferred to either the discharging unit 30 or an automatic duplex unit (ADU) 31 by a branch mechanism (not shown) which is provided downstream of the fuser 29, according to a request of a user. In a case where the paper P which is subjected to the fusing process by the fuser 29 is discharged, the paper P is transported to the discharging unit 30. In addition, in a case where an image is also formed on a rear surface of the paper P which is subjected to the image removing process by the fuser 29, the paper P is transported to the discharging unit 30 side once, and then is transported to the ADU 31 by switching back. In this case, as shown in FIG. 1, the ADU 31 feeds the paper P reversed by the switching back to the upstream side of the resist roller 24 again.

The operation panel 4 is a user interface. The operation panel 4 is generally arranged on a front side of the upper portion of the MFP 100 main body and includes a display 4*a* equipped with well-known various input buttons and a touch panel 4*b*. The system control unit 5 controls the content displayed on the display 4*a* of the operation panel 4. In addition, the operation panel 4 outputs information input by the touch panel 4*b* of the display 4*a* or the input buttons to the system control unit 5. An operator operates the operation panel 4 to select any one of two modes including a printing mode and an image removing mode. The printing mode is a mode for executing the fusing process by forming the image with the decolorable toner or non-decolorable toner onto the paper P set in the sheet feed cassette 20A. The image removing mode is a mode for executing the image removing process of the image formed onto the paper P set in the sheet feed cassette 20B. That is, in the image removing mode, the image formed onto the paper is removed using the sheet feeder 20, the transporting unit 22, and the fuser 29 without the image forming unit 25, the exposure unit 26, the intermediate transfer belt 27, and the transfer unit 28. Information required for printing such as the number of papers to be printed, the density, or the like to be input when in the printing mode or information related to each process such as the number of papers to be removed or the like to be input in the removing mode is stored in the predetermined area of the RAM as process information.

Next, a structure of the developer device 250 of the MFP 100 will be described with reference to FIGS. 2, 4, 5, and 6. The developer device 250 includes a housing 251, a developing roller 252, an elastic sheet 253, a first mixer 254 that is a developer stirrer, a second mixer 255 that is a developer supplying unit, a shield portion 257 which shields airflow from the developer device 250 to the photoreceptor drum 210, and an air passage 259 formed in the housing 251.

The first mixer 254 and the second mixer 255 are arranged inside the housing 251. The first mixer 254 and the second mixer 255 stir the developer inside the housing 251. The developer mixes the toner and the carrier formed of a magnetic substance such as iron powder, oxidation treated iron power, ferrite, and nickel.

Figure 5:
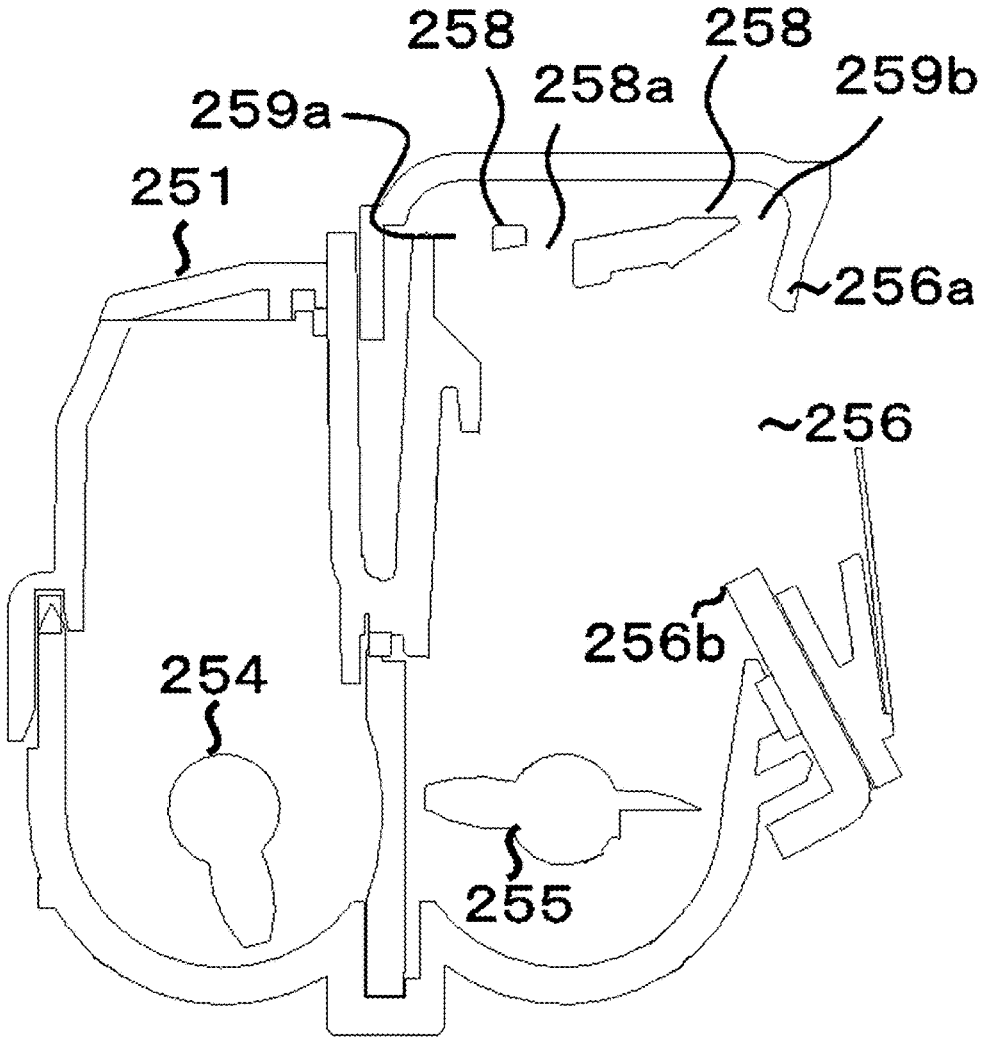
FIG. 5 is a cross-sectional view schematically illustrating an opening of the developer device according to the present embodiment.

As shown in FIG. 5, in the housing 251, an opening 256 is formed. The developing roller 252 is rotatably supported by the housing 251 and a portion of the developing roller 252 is exposed through the opening 256. A portion of the developing roller 252 that is exposed faces the photoreceptor drum 210 as shown in FIG. 2. In addition, the developing roller 252 is arranged on an upper side of the second mixer 255.

The developing roller 252 includes an axis portion 252*b* which is fixedly provided in the housing 251, a plurality of magnetic-pole portions which are fixed to the axis portion 252*b*, a cylindrical sleeve 252*a* which surrounds the axis portion 252*b* and the plurality of magnetic-pole portions and which is rotatable by a driving source.

The sleeve 252*a* of the developing roller 252 is rotated in a counterclockwise as shown in FIG. 2 (arrow r direction). In addition, the photoreceptor drum 210 is rotated in a clockwise direction (arrow n direction).

Figure 4A:
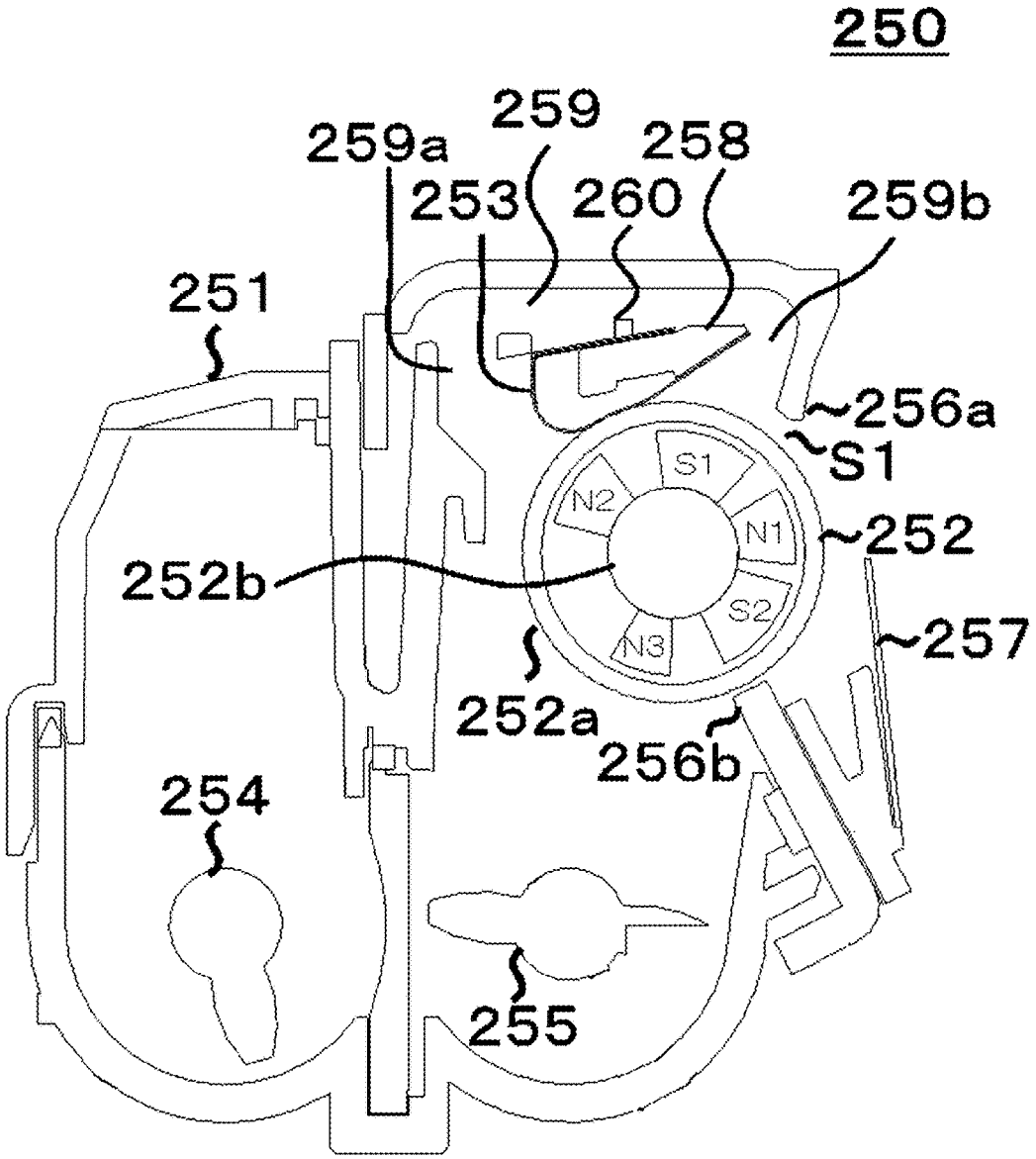
FIG. 4A is a cross-sectional view schematically illustrating a developer device according to the present embodiment.

The plurality of magnetic-pole portions of the developing roller 252 is, for example, a magnet. As shown in FIG. 4A, a main pole: N1 which is arranged so as to face the photoreceptor drum 210 with the sleeve 252*a* interposed in between, a transporting pole: S1, a separation pole: N2, a tab pole: N3, and a transporting pole: S2 are formed in this order in the rotation direction of the developing roller 252. The main pole: N1, the separation pole: N2, and the tab pole: N3 are each a N-pole and the transporting pole: S1 and the transporting pole: S2 are each a S-pole.

Figure 8:
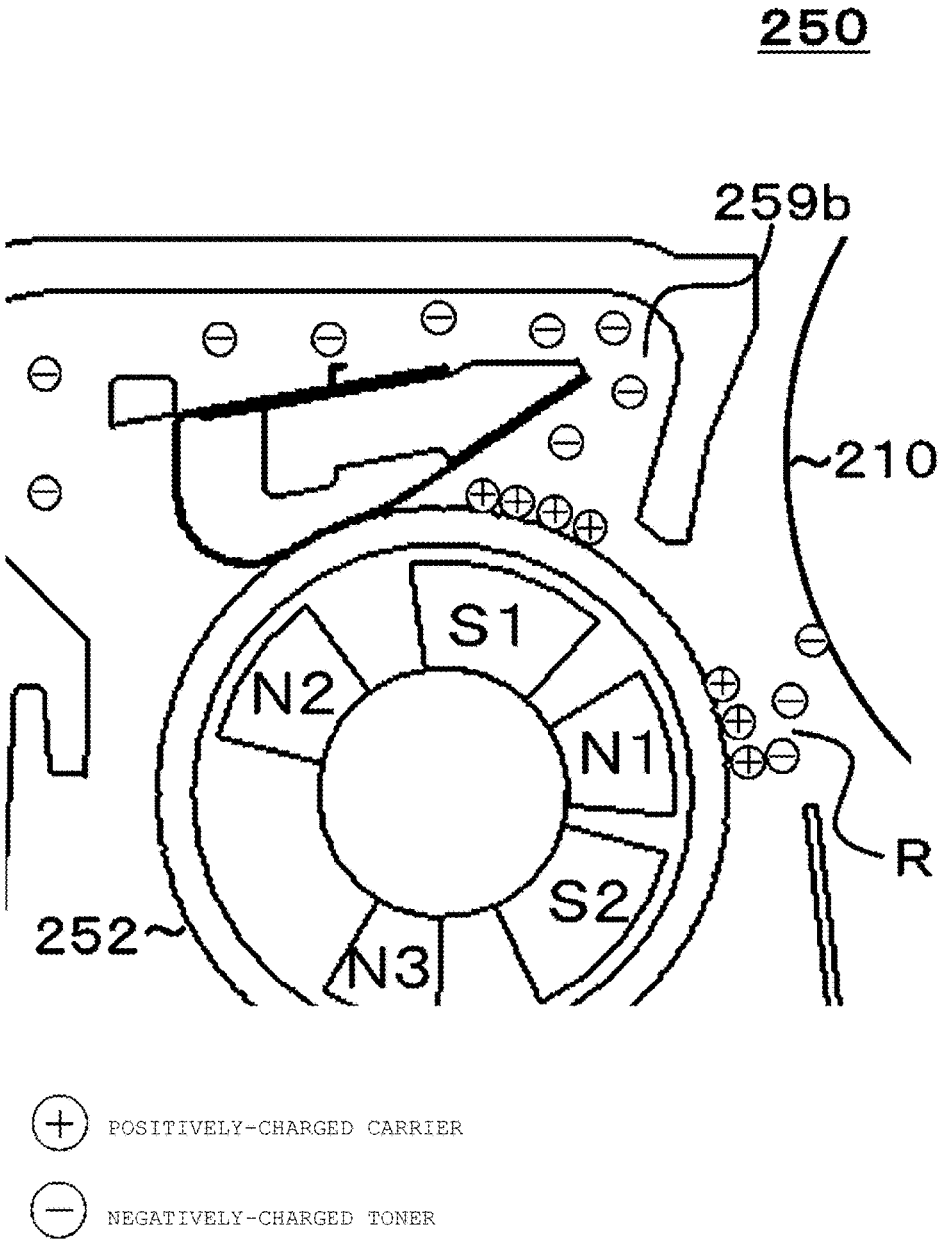
FIG. 8 is an explanatory diagram schematically illustrating a motion of a carrier and a toner within the developer device according to the present embodiment.

The developer is attached to the developing roller 252 by a magnetic force of the tab pole: N3, and is transported to the main pole: N1 through the transporting pole: S2. As shown in FIG. 8, the main pole: N1 forms a developing region R. In the developing region R, the toner included in the developer is moved from the developing roller 252 to the photoreceptor drum 210 and the developing is performed on the latent image of the photoreceptor drum 210. Thereafter, the developer is transported to the separation pole: N2 through the transporting pole: S1. The developer attached to the developing roller 252 is separated by magnetic repulsion of the separation pole: N2 and the tab pole: N3.

Figure 6:
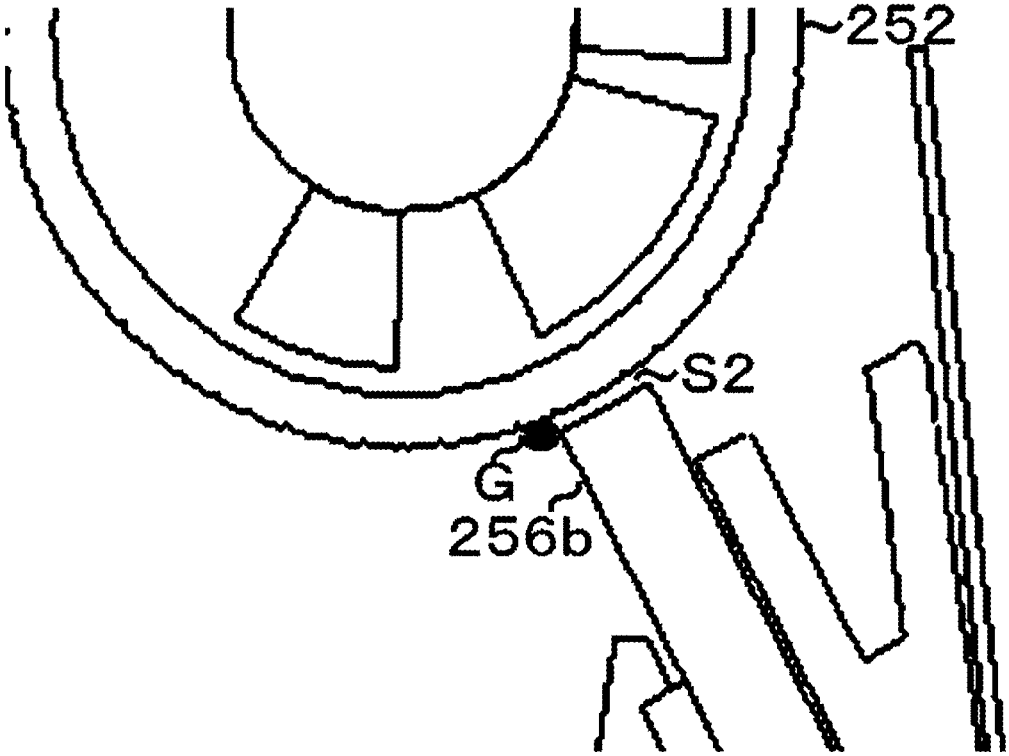
FIG. 6 is an explanatory diagram schematically illustrating a lower end portion of the opening and a developing roller of the developer device according to the present embodiment.

As shown in FIG. 4A, in the gap between the developing roller 252 and an upper side end portion 256*a* of the opening 256 facing the developing roller 252, a space S1 is formed. On the other hand, in a lower end portion 256*b* of the opening 256 and the developing roller 252, the lower end portion 256*b* of the opening 256 can scrape excess developer attached to the developing roller 252; and the developing roller 252 and the lower end portion 256*b* of the opening 256 are prevented from contacting each other by a distance. Therefore, a space S2 is formed in the lower end portion 256*b* of the opening 256 of the housing 251 and the developing roller 252 as shown in FIG. 6. However, as described above, since the lower end portion 256*b* of the opening 256 scrapes the developer to be formed on the surface of the developing roller 252, the space S2 is blocked by a scraped developer G. Since the space S2 is not fully blocked by the scraped developer G in some cases, the shield portion 257 is formed between the lower end portion 256*b* of the opening 256 and the photoreceptor drum 210.

A guide portion 258 that guides air to be discharged outside the housing 251 is arranged inside the housing 251. The guide portion 258 is arranged at the upstream side of the developing roller 252 so as to face the inner wall of the housing 251. The guide portion 258 includes a pawl portion 260 and a sheet insertion port 258*a* as shown in FIG. 5 in a surface facing the inner wall of the housing 251. A portion of the elastic sheet 253 is inserted to the sheet insertion port 258*a* (refer to FIG. 4A). A hole is formed in an end portion of the inserted elastic sheet 253 and the pawl portion 260 is inserted into the hole. The air passage 259 is formed by a portion of the elastic sheet 253 and the guide portion 258 and the housing 251.

As shown in FIG. 4A, the air passage 259 includes a first opening portion 259*a* that is an inlet port of the air passage 259 and a second opening portion 259*b* that is an outlet port of the air passage 259. The first opening portion 259*a* that is the inlet port of the air passage 259 is formed on an upper side of the second mixer 255. The second opening portion 259*b* that is the outlet port of the air passage 259 is provided adjacent to the opening 256 and formed so as to face the developing roller 252. In addition, the second opening portion 259*b* is provided downstream of the developing roller 252 in a rotational direction of the developing roller 252 in relation to the main pole: N1 (that is, a side where the developer of the developing roller 252, that is processed by developing to the photoreceptor drum 210, is transported inside the housing 251 again) (refer to FIG. 2). Therefore, as shown in FIG. 4A, the air passage 259 is formed so as to bypass the upper side of the developing roller 252. In addition, the air passage 259 forms a passage so as to blow air discharged from the second opening portion 259*b* to the developing roller 252 which transports the developer inside the housing 251.

Figure 4B:
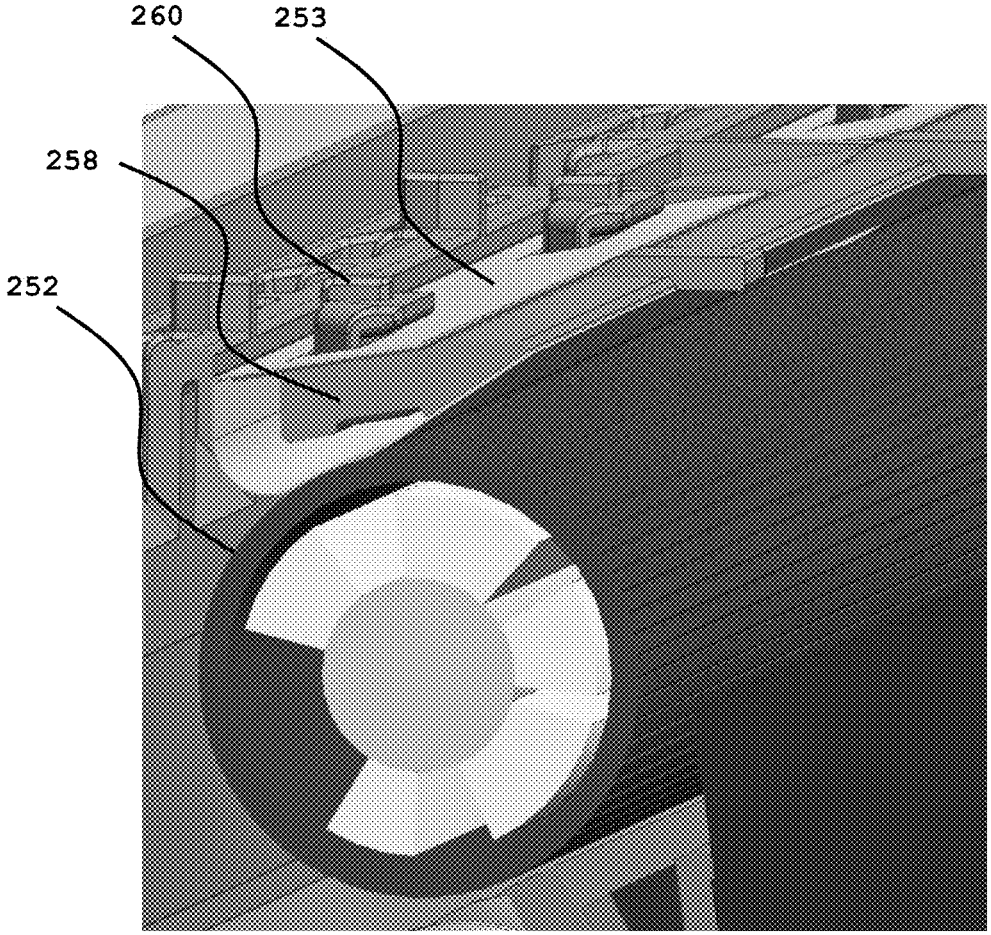
FIG. 4B is a partial perspective view illustrating an elastic sheet employed in the developer device according to the present embodiment.

In addition, as shown in FIGS. 4A and 4B, the developing roller 252 is in contact with the elastic sheet 253 on the upper side of the developing roller 252. The elastic sheet 253 is a shielding portion having the function of a valve that prevents airflow including the toner to be discharged from the housing 251 to outside of the housing 251. A material of the sheet is, for example, a member with a predetermined flexibility such as urethane or the like. One end of the elastic sheet 253 is attached to the guide portion 258 with a tape or the like. The one end of the elastic sheet 253 is attached to the guide portion 258 between the first opening portion 259*a* that is the inlet port of the air passage 259 and the second opening portion 259*b* that is the outlet port of the air passage 259. The elastic sheet 253 extends to the downstream side of the developing roller 252 and the hole at the other end of the elastic sheet 253 is inserted to the pawl portion 260 provided in the guide portion 258 as described above in a substantially U-shape. According to the configuration, a portion of the guide portion 258 and the elastic sheet 253, and the housing 251 form the air passage 259. As described above, by providing a structure in which one end of the elastic sheet 253 is fixed and the other end is fixed by hooking the pawl portion 260, it is possible give the elastic sheet 253 a degree of freedom. Therefore, the elastic sheet 253 can be formed into a loop-shape without wrinkling and the elastic sheet 253 can come into contact with the developing roller 252.

Figure 7:
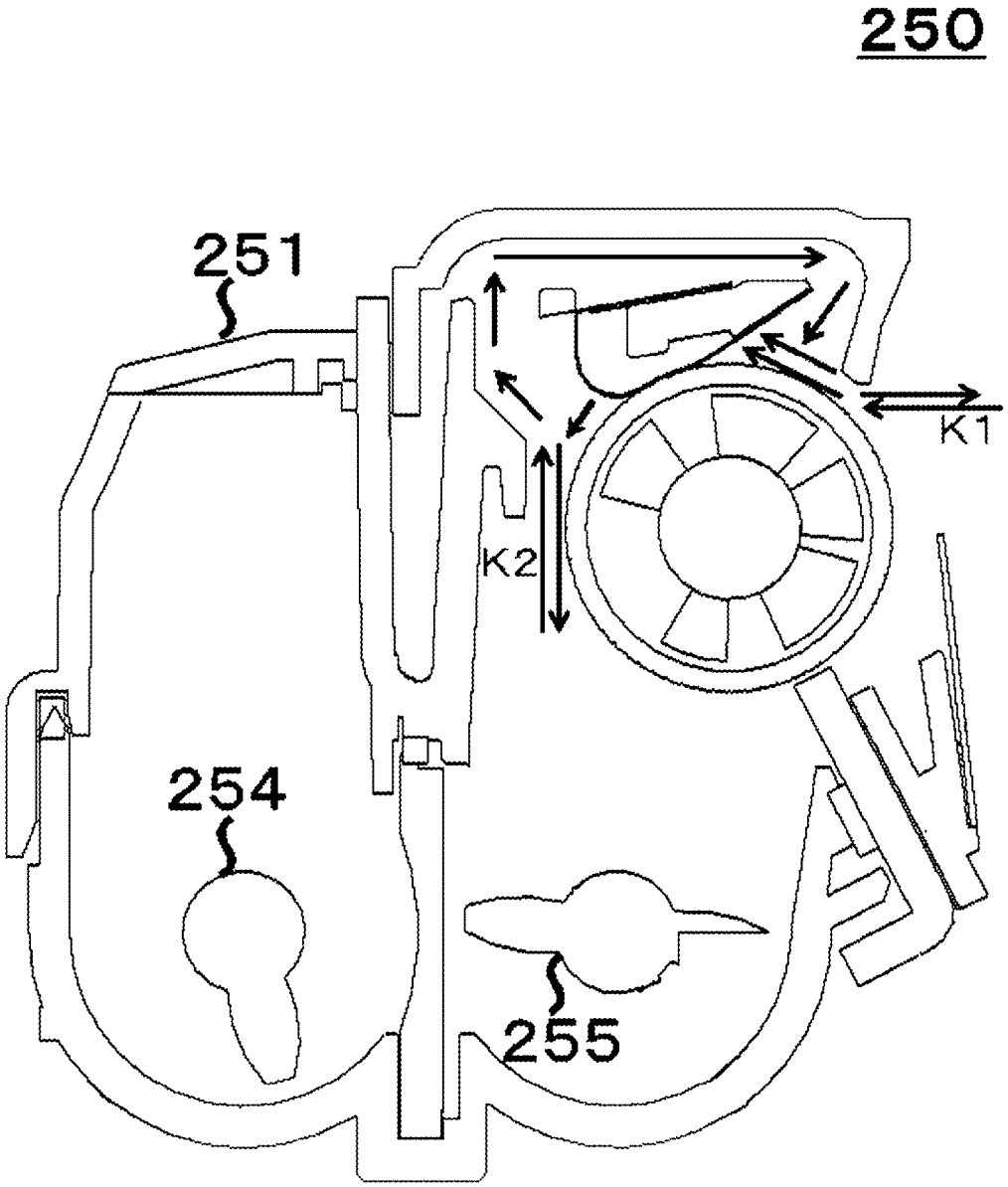
FIG. 7 is an explanatory diagram schematically illustrating airflow in the developer device according to the present embodiment.

Subsequently, the airflow in the developer device 250 having such a structure will be described with reference to FIG. 7. By rotating the developing roller 252 in the arrow r (counterclockwise) direction, airflow K1 occurs and air enters the housing 251 through the space S1. When the air enters, since the space S2 is blocked by the developer G as described above, the internal pressure of the housing 251 becomes increased. Accordingly, airflow K2 from the inside the housing 251 to the outside the housing 251 occurs. Since the airflow K2 is toward the space S1 which functions as the outlet port, the airflow becomes an updraft flowing through the first opening portion 259*a* of the air passage 259. At this time, the airflow K2 recovers the toner separated from the developer inside the housing 251, and is directed toward the first opening portion 259*a* of the air passage 259.

Air containing the toner enters the air passage 259 from the first opening portion 259*a* and discharged at the second opening portion 259*b* through the air passage 259. The air containing the toner discharged at the second opening portion 259*b* impinges on the developing roller 252.

Since the airflow K1 into the housing 251 is generated by the rotation of the developing roller 252, most air containing the toner discharged at the second opening portion 259*b* and the developer are discharged into the housing 251 again and a portion of the air flows to the outside the housing 251. That is, the air blown from the second opening portion 259*b* is received by the developer of the developing roller 252. Accordingly, the air that is flowing with the developer that was attached to the developing roller 252 and the toner are transferred to inside the housing 251. By the above-described configuration, it is possible to generate a circulation path of the airflow containing the toner inside the housing 251.

Here, as shown in FIG. 8, the carrier of the developer is positively charged and the toner is negatively charged. As shown in FIG. 8, the toner moves from the developing roller 252 to the photoreceptor drum 210 in the developing region R. Therefore, after the developer of the developing roller 252 passes through the developing region R, where the negatively charged toner moves to the photoreceptor drum 210, a lot of the positively charged carrier remains on the sleeve 252*a* adjacent to the transporting pole: S1. In this state, the air containing the toner is blown from the second opening portion 259*b* onto the developing roller 252. Since the toner is negatively charged, the toner is captured by the positively charged developer and transported inside the housing 251 again.

In addition, as shown in FIG. 4A, the transporting pole: S1 is provided so as to face the second opening portion 259*b* with the sleeve 252*a* interposed in between. By the magnetic force of the transporting pole: S1, the developer of the sleeve 252*a* facing the transporting pole: S1 is in a state where the magnetic flux is formed.

Since the air containing the toner discharged from the second opening portion 259*b* impinges on the developer in the state where the magnetic flux is formed, the toner is easily captured by the developing roller 252.

By each positional relationship between the second opening portion 259*b*, the transporting pole: S1, and the developing region R, the air, after the toner is captured by the positively charged developer, is discharged from the space S1 outside the developer device 250, and the captured toner returns inside the housing 251 by the developing roller 252.

By the above configuration, since the second opening portion 259*b* is provided adjacent to the downstream side of the photoreceptor drum 210 and the space S1, the air containing the toner to be discharged from the housing 251 impinges on the developer of the developing roller 252 in a state where the magnetic flux is formed. As compared to locations where the magnetic flux is not formed and the developer lies down (e.g., on the outer surface of the developing roller 252 between locations corresponding to N1 and S1), in locations where the magnetic flux is formed (e.g., on the outer surface of the developing roller 252 at locations corresponding to N1 and S1), the toner can be easily captured from the air containing the toner, and so it is possible to reduce the toner scattering by the developer device 250.

In addition, at a timing such as when printing of the image is completed, the developing roller 252 is rotated in a direction opposite to the r direction for image quality maintenance. At this time, since the elastic sheet 253 is formed into the loop-shape, the elastic sheet 253 is not lifted up.

Recently, a product life of the developer device or the like tends to be longer. Accordingly, in the product of the related art, the amount of clogging of the filter that captures the toner has increased, even before the product lifetime has expired. In addition, in order to provide the filter, a fan or a duct is required, which leads to an increase of the device size. However, according to the present embodiment, since the filter is not required, it is possible to provide the developer device of a reduced size and with improved maintenance performance.

Figure 9:
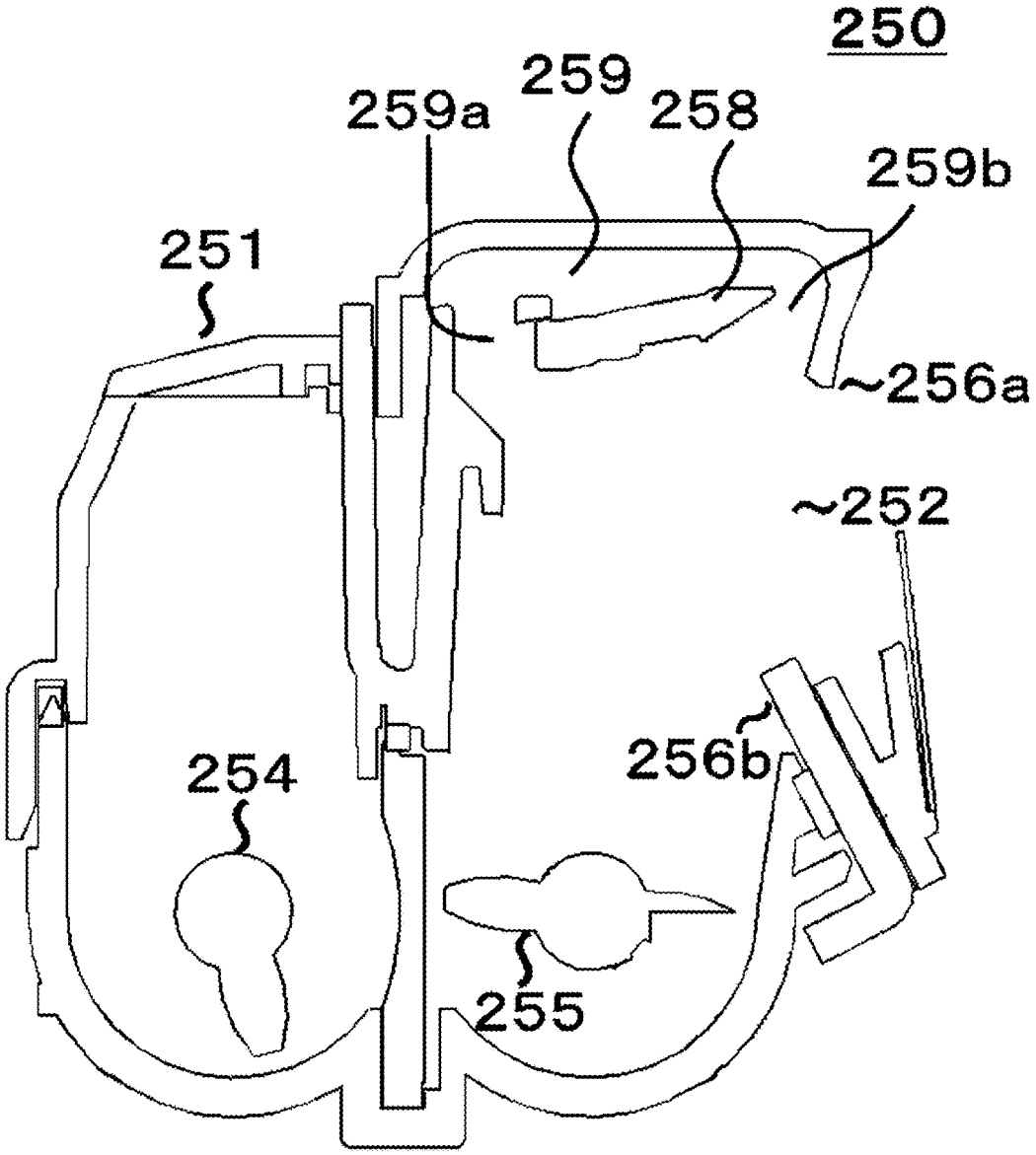
FIG. 9 is an explanatory diagram schematically illustrating the developer device without a sheet according to the present embodiment.

In the present embodiment, the elastic sheet 253 is provided on an upper side of the developing roller 252, but the elastic sheet 253 may not be provided. In such a case, as shown in FIG. 9, the sheet insertion port 258*a* is not formed in the guide portion 258. The air passage 259 is formed by the inner wall of the housing 251 and the guide portion 258.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein maybe made without departing from the spirit of the inventions. The accompanying claims and their equivalents are intended to cover such forms or modifications as would fall within the scope and spirit of the inventions.

What is claimed is:

1. A developing method in a developer device having a developing roller configured to rotate within a housing, the developing roller having a first portion that is exposed through an opening of the housing, a second portion at which developer attached to the developing roller separates from the developing roller and a third portion between the first and second portions, and an elastic sheet in contact with the developing roller between the second and third portions of the developing roller, the method comprising:

guiding airflow along a first airflow passage, which is formed in the housing and partially facing the second portion of the developing roller; and guiding airflow along a second airflow passage facing the third portion of the developing roller and adjacent to the first airflow passage.

2. The method according to claim 1, wherein the developing roller includes fixed magnets and a rotating sleeve surrounding the fixed magnets.

3. The method according to claim 2, wherein the fixed magnets include a first magnet located at a first interior portion of the rotating sleeve directly opposite to the first portion, a second magnet located at a second interior portion of the rotating sleeve directly opposite to the second portion, and a third magnet located at a third interior portion of the rotating sleeve directly opposite the third portion and between the first and second interior portions of the rotating sleeve.

4. The method according to claim 3, wherein the first and second magnets have the same polarity and the third magnet has a polarity opposite to that of the first and second magnets.

5. The method according to claim 1, wherein the elastic sheet is formed to have a loop-shape.

6. The method according to claim 1, wherein the elastic sheet is formed of urethane.

7. The method according to claim 1, wherein the elastic sheet extends along a rotational direction of the developing roller.

8. The method according to claim 1, wherein the developer device further comprises a shielding portion that blocks airflow between portions of the developing roller between the first portion and a fourth portion of the developing roller at which excess developer attached to the developing roller is scraped off.

9. The method according to claim 1, wherein the developer device further comprises a mixer for the developer below the developing roller, and the developer includes toner and carrier that are oppositely charged.

* * * * *